US006327940B1

(12) United States Patent
Price

(10) Patent No.: US 6,327,940 B1
(45) Date of Patent: Dec. 11, 2001

(54) MULTI-PIECE MANUAL TONG SAFETY HANDLE

(75) Inventor: H. Paul Price, Houston, TX (US)

(73) Assignee: National-Oilwell, L.P., Houston, TX (US)

( * ) Notice: Subject to any disclaimer, the term of this patent is extended or adjusted under 35 U.S.C. 154(b) by 0 days.

(21) Appl. No.: 09/505,074

(22) Filed: Feb. 16, 2000

(51) Int. Cl.[7] ..... B25B 23/16
(52) U.S. Cl. ..... 81/177.1
(58) Field of Search ..... 81/177.1, 489, 81/57

(56) References Cited

U.S. PATENT DOCUMENTS

| | | | | |
|---|---|---|---|---|
| 839,727 | * | 12/1906 | Carnahan | 81/489 |
| 2,488,309 | * | 11/1949 | Mason | 220/759 |
| 3,728,793 | * | 4/1973 | Makinson et al. | 30/383 |
| 4,138,812 | * | 2/1979 | Zimmerer et al. | 30/381 |
| 4,401,167 | * | 8/1983 | Sekizawa et al. | 173/162.1 |
| 4,609,055 | * | 9/1986 | Grafstrom et al. | 173/162.2 |
| 5,219,164 | * | 6/1993 | Peng | 473/520 |
| 5,333,925 | | 8/1994 | Foley, Jr. | 294/86.4 |
| 6,048,125 | * | 4/2000 | Droche et al. | 403/12 |
| 6,145,899 | * | 11/2000 | Kelemen | 294/57 |

* cited by examiner

*Primary Examiner*—Joseph J. Hail, III
*Assistant Examiner*—David B. Thomas
(74) *Attorney, Agent, or Firm*—Conley, Rose & Tayon, P.C.

(57) ABSTRACT

A multi-part handle system that incorporates bumper flanges disposed at opposite ends of a rigid handle device is proposed. The handle mounts to a manual tong apparatus, or any other piece of heavy equipment, by means of weldable or integrally cast brackets and provides a rigid but shock absorbing grip for the operator's hand. In the event that the bumper flanges become damaged or are torn off the handle assembly the rigid handle device will continue to provide a safe manipulation means while replacement bumpers are located. In contrast to prior art safety handles, rig operators will be able to deploy safety handles without the fear of lost rig time if the bumper components become damaged. A soft ergonomic grip cover is incorporated into the preferred embodiment of the safety to make gripping the handle assembly more comfortable and tactile for the operator.

31 Claims, 3 Drawing Sheets

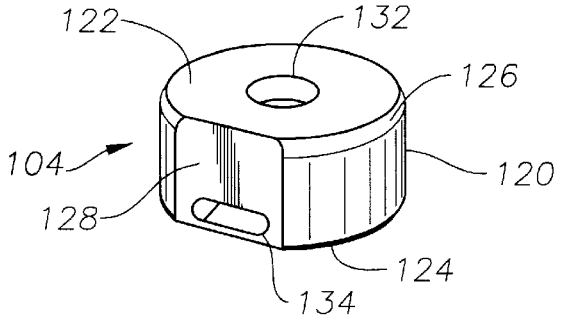
Fig. 5
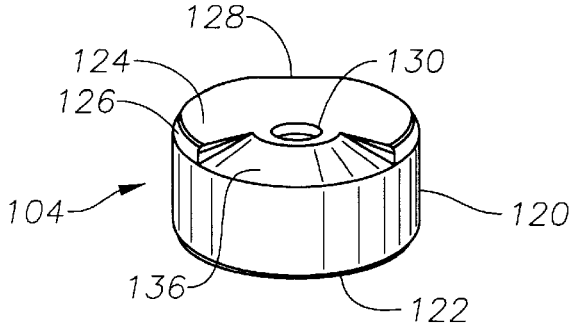
Fig. 6
Fig. 7
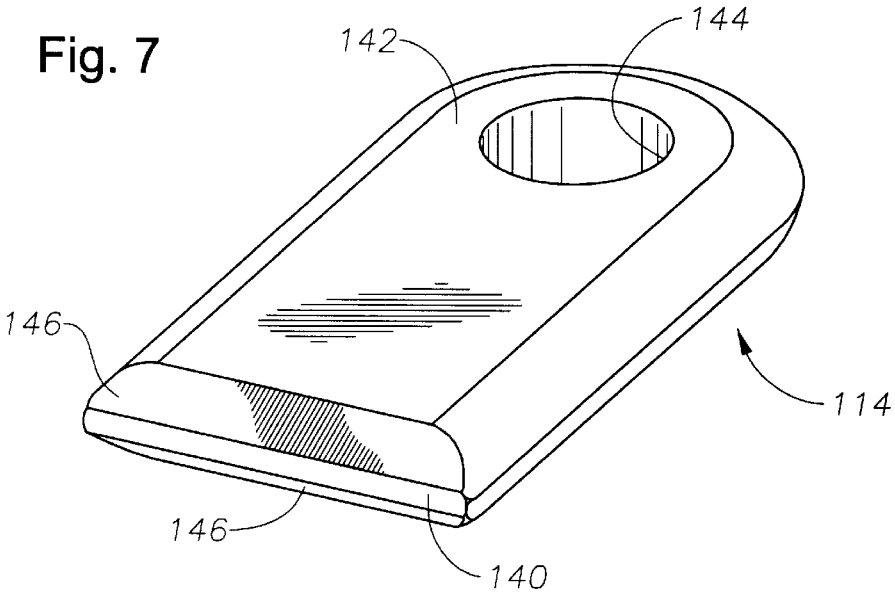
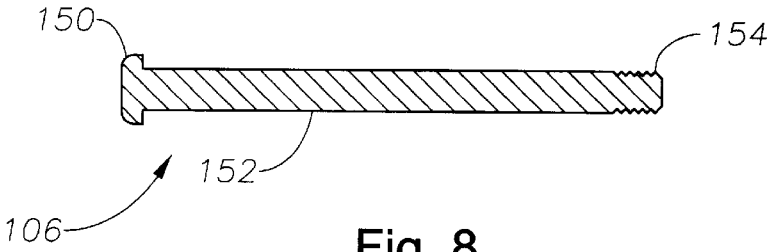
Fig. 8

MULTI-PIECE MANUAL TONG SAFETY HANDLE

CROSS-REFERENCE TO RELATED APPLICATION

None.

BACKGROUND OF THE INVENTION

1. Field of the Invention

The present invention generally relates to the use of safety handles that are placed about the periphery of heavy equipment to protect the operator's hands from injury. More particularly, the invention relates to safety handles that are mounted to the periphery of manual pipe tongs, which are typically used in the oilfield drilling industry. More particularly still, the invention relates to multi-piece, reinforced, and replaceable handles for manual pipe tongs that protect oilfield workers' hands from injury that might otherwise result from impact with adjacent equipment.

2. Description of the Related Art

Manual pipe tongs are used throughout the oilfield industry to apply torque to various tubular components of generally cylindrical shape. This application of torque is most often used to secure, tighten (make-up), and loosen (break-out) the threaded rotary connections of drill pipe, drilling collars, casing and tubing. Pipe tongs typically function by incorporating a cantilevered configuration that holds the workpiece in a grip that tightens or loosens depending on the direction that torque is applied to the lever arm.

FIG. 1 shows a typical prior art manual tong assembly 10 as used in oilfield drilling operations to secure or rotate a cylindrical workpiece 12. Manual tong assembly 10 includes a long jaw 14, a short jaw 16, a lug jaw 18, and a lever arm 20 all connected together at pivot points 22*a, b, c, d.* A latch 24 is pinned to one end of the long jaw 14 and fits into a receiver step 26 at the end of the lug jaw 18.

FIGS. 2*a* and 2*b* show how different workpiece 12 sizes can be accommodated by adjusting the lengths and configurations of lug jaw 18. FIG. 2*a* shows the lug jaw 18 of FIG. 1 that includes an array of mounting locations 28 and a choice of receiver steps, 26 and 30, that may be used to adjust the manual tong apparatus 10 to various diameters of workpiece 12 (e.g. pipe diameters). Alternatively, FIG. 2*b* details a lug jaw 32 that is longer in length and includes a hinged portion 34 attached to the lug portion 36 by means of a hinge pin 38 so as to allow even larger diameter workpieces to be accommodated by tong assembly 10.

Referring again to FIG. 1, jaws, 14, 16, and 18 are positioned in place around workpiece 12 and locked into place with latch 24. In some instances, each jaw may contain one or more sets of sharpened teeth called tong dies 40 that are used to "bite") into workpiece 12 and prevent slippage when manual tong 10 is engaged. Once latch 24 is engaged, lever arm 20 can be rotated in direction $\alpha$ so as to load latch 24 in tension and engage and apply torque to workpiece 12 in that direction. Rotating lever arm 20 in direction $\omega$ will loosen the grip of jaws (14, 16, and 18) on workpiece and allow latch 24 to be opened. Because tool 10 is quite large, with lever arm 20 typically being 3–6 feet long, operation usually requires more than one person. Several handles, such as 42 or 44, are typically placed about the periphery of manual tong assembly 10 to provide locations for rig workers to guide it when moving tong assembly 10 into position on the pipe, or to remove it from the pipe.

Manual tong 10, as illustrated, is configured to grip workpiece 12 only when torque is applied in the $\alpha$ direction.

Typical rig operations incorporate two sets of manual tongs, with each being a mirror image of the other, so that one tightens in clockwise direction and the other in a counter-clockwise direction. Each can tighten or loosen the pipe threads, depending on whether it is installed in the upper position and engages the pin (male) connection or the lower position for engaging and holding the box (female) counter. Typical operations will include the use of two, opposed tongs. When more than one tong is used, their positions on the workpiece relative to each other depends on the operation being performed and the type of additional rig equipment used.

Operators typically position and manipulate manual tongs 10 by grabbing handles that are provided about the periphery of the tongs as, for example, handles 42 and 44 in FIG. 1. FIGS. 3*a,* 3*b,* and 3*c* show three different designs of tong handles that have been previously known and used on manual tong assemblies. FIG. 3*a* shows a manual tong apparatus that includes a handle 50 made from U-shaped a cylindrical rod that has been cast or welded onto the body 52 of the tong. To manufacture handle 50, the cylindrical rod is bent into top, middle, and bottom sections 54, 56, 58, respectively. Although this design is the simplest and most cost effective for a manual tong manipulator handle, it offers the least protection to the operator, as a hand wrapped around handle 50 is exposed to blows from above, below, or horizontally.

In order to gain maximum protection from injury while using tongs with a handle of this design, the operator must fight his natural tendency to place his hands on top 54 and bottom 58 portions and must grip only middle portion 56 of handle 50. This is because serious injury can result to an operator's hands when he is manipulating one set of tongs around the pipe while another set of tongs is being manipulated around the pipe, either above or below his tongs. If an operator's hand is exposed while two sets of adjacent tongs move relative to each other, it can be pinched or crushed between the tongs. The design of FIG. 3*a* offers little protection from injuries of this type, as the operator is comfortably able to grip the handle in any number of unsafe ways.

FIG. 3*b* demonstrates a handle system 60 that is designed to prevent the type of hand injuries experienced while using the design of FIG. 3*a*. Handle 60 includes a tong body 62 with a rod-style handle 64 as before, but with the addition of metal guard plates positioned in a horizontal plane of each end of vertical handle 64. Metal guard plates 66 and 68 are intended to both restrict placement of hands to the center section of handle 64 and to protect the operator's hands from being crushed or impaled by an adjacent tong or other nearby equipment. Metal plates 66 and 68 can be either cast or welded into place as original equipment when the tong body 62 is manufactured or can be retrofitted to existing tongs as a safety upgrade. While the addition of metal plates 66, 68 is an improvement to the handle assembly 50 of FIG. 3*a,* they do not offer any shock absorbing characteristics. If an operator were to have a hand resting upon metal plates 66, 68 and that hand were to be impacted by another object, it is possible that the operator's hand or fingers could become crushed or severed. To ensure that tong handle devices pose as little safety risk as possible, it is best that they be manufactured or retrofitted with shock absorbent devices.

FIG. 3*c* shows another embodiment for a tong handle, which utilizes a one-piece polyurethane dumbbell-shaped design to address the shock absorbency concerns of handle 60 of FIG. 3*b*. Polyurethane dumbbell 70 is attached to tong body 72 by cutting out middle portion 56 in FIG. 3*a* and utilizing horizontal portions 54 and 58 (74 and 76 in FIG. 3*c*). One-piece dumbbell 70 includes a generally cylindrical handle section 78 with disc shaped flange portions 80, 82 above and below handle section 78. Holes are drilled for spring pins in the ends of horizontal members 74 and 76, and one-piece dumbbell 70 is fitted onto horizontal members 74 and 76. Separate spring pins, 84, 86 are driven through opposite ends of dumbbell handle 70, to engage horizontal members 74 and 76 and hold dumbell 70 in place on tong body 72. Flanged portions 80 are preferably larger in diameter than an operator's fist so that they are able to act as large bumpers to protect operator's hands from damage.

Dumbbell 70 is manufactured of a shock absorbing material. When operator uses dumbbell handles 70 to manipulate manual pipe tongs, his hands are protected from impact and scrapes with other equipment as long as his hands are positioned on cylindrical handle section 78. Unfortunately, the dumbbell design of FIG. 3*c* has drawbacks that can reduce its effectiveness, preventing many drilling contractors from adopting it.

One-piece dumbbell 70 is sometimes installed as a retrofit on tongs with existing handles as shown in FIG. 3*a*. The vertical distance between existing horizontal members 74 and 76 in FIG. 3*c* is typically different for various handle locations on the same tong, and of course, on different tong models. Due to the need for economical production of a one-piece molded dumbbell handle 70, one size of one-piece dumbbell handle 70 is utilized in as many different locations as possible. This results in some compromises in fitting, such that one-piece dumbbell handle 70 is sometimes installed in a slightly bent or compressed or stretched or loose condition, which may contribute to a premature failure of this part.

Because the material of dumbbell 70 must be somewhat soft in order to have good shock absorbing properties, it is also somewhat flexible. The flexibility of handle portion 78 can cause it to break and tear away prematurely. In the event of a failure of handle portion 78, dumbbell 70 is unusable and must be replaced before the tong 72 can be safely operated again. If a replacement is not immediately available, since minimal amounts of replacement parts are typically carried on the work location, a drilling rig crew might be tempted to manipulate the manual tong apparatus outside the designated handle area 78, such as by grasping 74 and manipulating tong 72 with hands outside the protected area between 74 and 76. This temptation to use the crippled tong assembly in an unsafe manner, while parts are on order, results in greatly increased risks to the health and safety of the operator.

Because of the increased potential for injury in the event of a failure of this design, drilling operators may be reluctant to deploy dumbbell handles 70 with their manual tong assemblies, thus not taking advantage of any safety improvements that that may otherwise be realized. Hence, it is desirable to provide an effective manual tong handle that is safer, more reliable, and reduces the risk of injury.

BRIEF SUMMARY OF THE INVENTION

The need noted above can be addressed in large part by a multi-part handle system that incorporates bumper flanges disposed at opposite ends of a rigid handle device. The present system attaches to a manual tong apparatus, or any other piece of heavy equipment, by means of weldable brackets securely attached to the handle device. The present new design includes bumper flanges that provide shock absorbing protection for the operator's hand, while the handle device provides rigidity and durability. In the event that the bumper flanges become damaged or are torn off the handle assembly, the rigid handle device will continue to provide a safe manipulation means until replacement bumpers are obtained. This feature offers a dramatic improvement, as it allows rig operators to deploy safety handles without the fear of lost rig time if the bumper components become damaged, a situation that designs of the prior art do not effectively address. Additionally, a soft ergonomic grip cover is incorporated into the preferred embodiment of the present invention to make gripping the handle assembly more comfortable and tactile for the operator.

BRIEF DESCRIPTION OF THE DRAWINGS

For a detailed description of a preferred embodiment of the invention, reference will now be made to the accompanying drawings wherein:

FIG. 3*c* is a cross-sectional view of another alternative embodiment to the manipulation handle of FIG. 3*a.

FIG. 5 is an isometric view of the top and back of the elastomeric flange of FIG. 4;

FIG. 6 is an isometric view of the bottom and front of the elastomeric flange of FIG. 4;

FIG. 7 is an isometric drawing of the attachment plate of FIG. 4; and

FIG. 8 is a sectioned drawing of the handle member of FIG. 4.

Figure 2A:
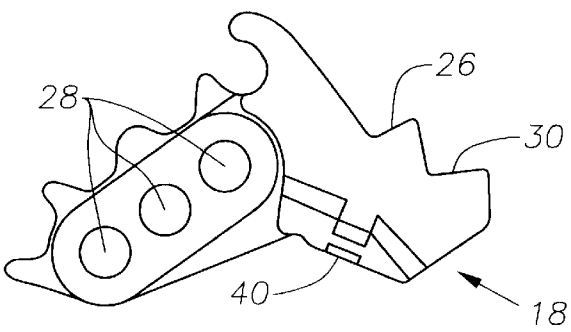
Fig. 2a (Prior Art)
FIG. 2*a* is a detail drawing of a lug jaw of the prior art manual tong apparatus of FIG. 1.
Figure 2B:
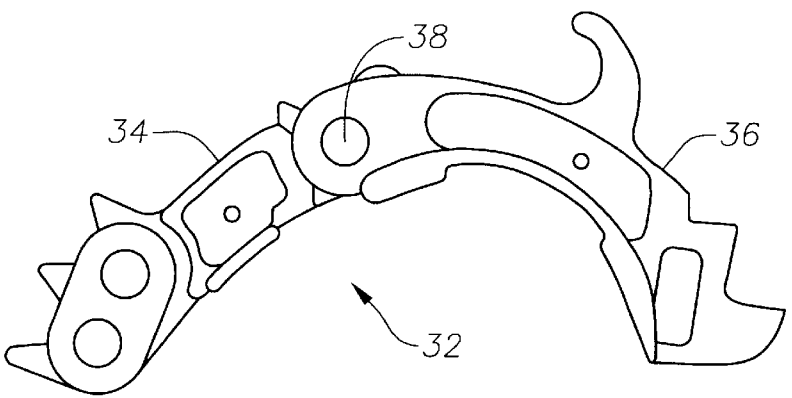
Fig. 2b (Prior Art)
FIG. 2*b* is an alternative embodiment of the lug jaw of FIG. 2*a;*
Figure 1:
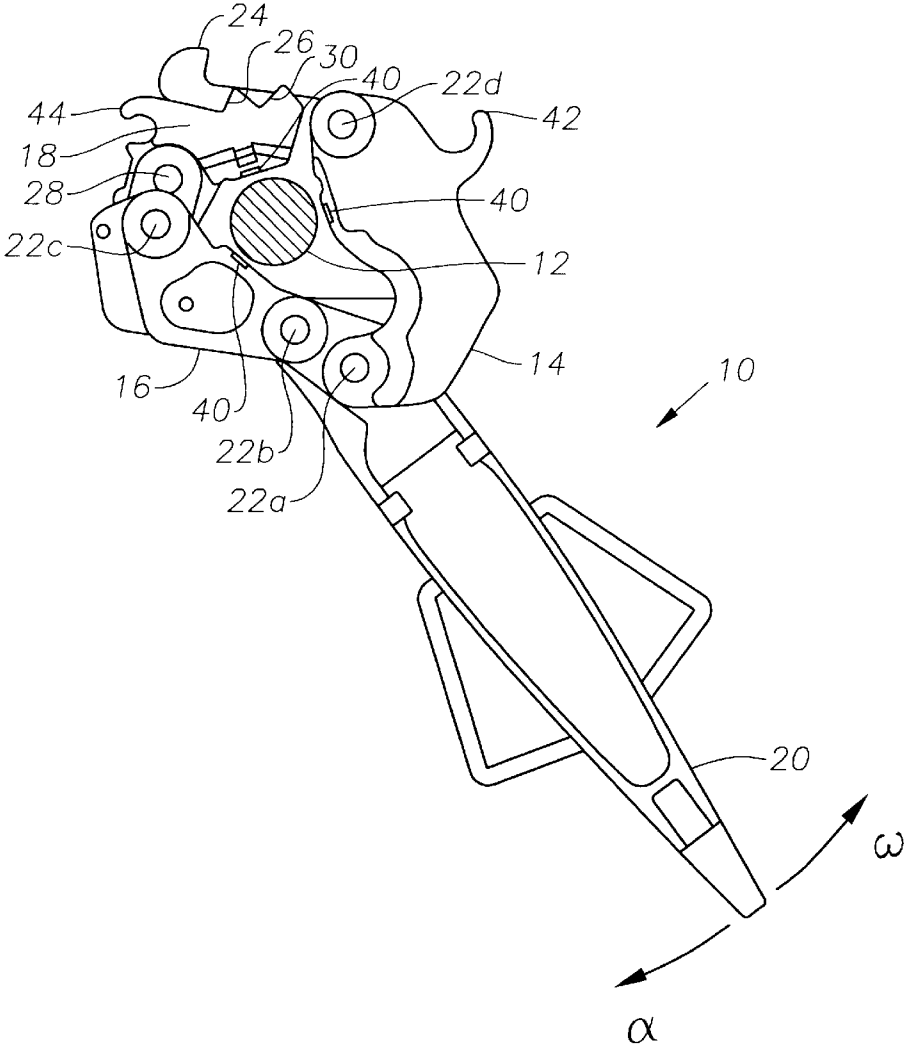
Fig. 1 (Prior Art)
FIG. 1 is a drawing of a prior art manual tong apparatus.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Figure 4:
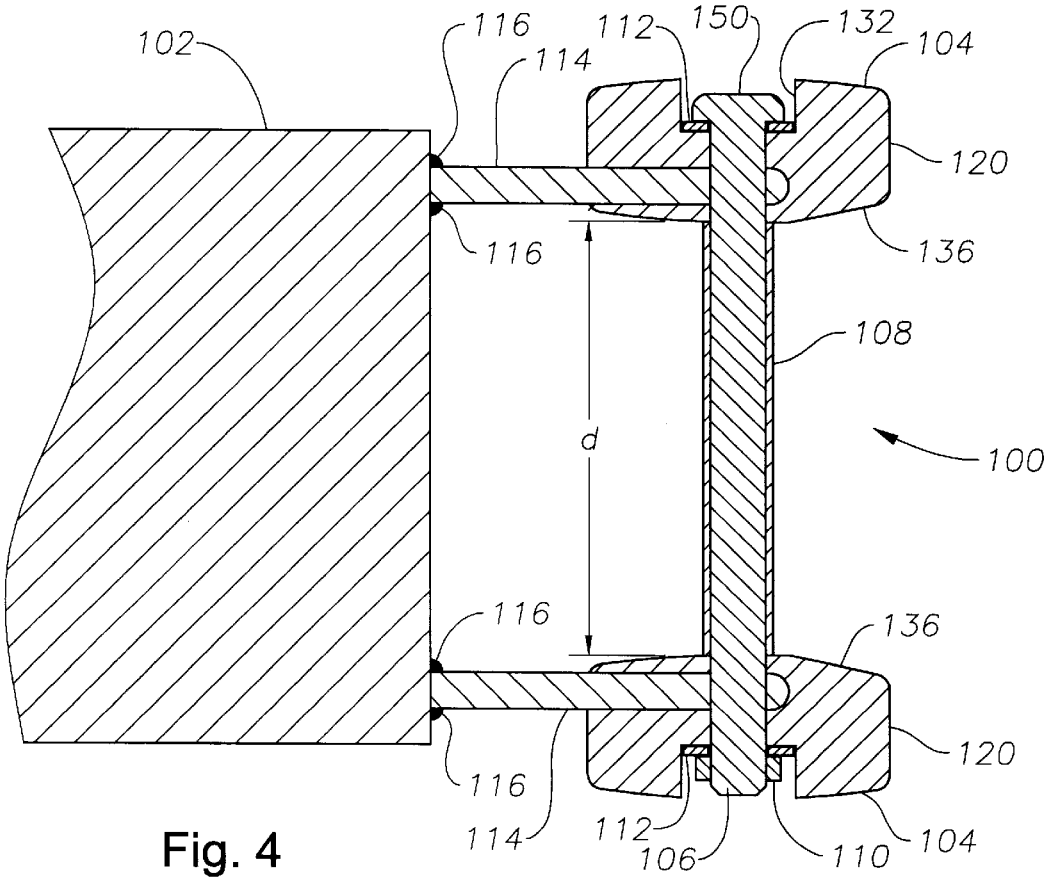
* and FIG. 4 is a cross-sectioned view of a handle apparatus for a manual tong assembly in accordance with the preferred embodiment of the present invention.

FIGS. 4–8 show components of a preferred embodiment of a novel multi-piece safety handle for an oilfield manual pipe tong device. Referring initially to FIG. 4, a multi-piece safety handle assembly 100 is shown attached to a manual tong device 102. Handle assembly 100 includes two bumper flanges 104, a rigid handle member 106, an elastomeric grip cover 108, a retainer 110, and flat washers 112. Handle assembly 100 is secured to tong body 102 by two attachment plates 114. Attachment plates 114 are positioned on the exterior of tong body 102 in the desired location of handle assembly 100 and are preferably affixed to tong body 102 by welds 116.

FIG. 5 details a top-back isometric view of bumper flange 104 and FIG. 6 details a bottom-front isometric view of the same component. While the following discussion relates to upper bumper flange 104, it will be understood that the same concepts and features are preferably applied to lower flange 104, although in an inverted manner. Referring to FIGS. 5 and 6 concurrently, it can be seen that the preferred embodiment of bumper flange 104 includes an outer profile 120, a top face 122, and a bottom face 124. Filleted, or radiused, transition portions 126 exist between both faces, 122 and 124, and outer profile 120. Additionally, a flat faced feature 128 is located on profile 120, towards the back of bumper flange 104 between top 122 and bottom faces 124. A bore hole 130 extends through bumper flange 104 from top face 122 to bottom face 124. A countersink 132 is coaxial with bore 130 and extends from top face 122 partially through flange 104. Extending from flat face 128 into the interior of bumper flange 104 is an attachment plate socket 134 that fits the cross section width of attachment plate 114. Located in the bottom face 124 of bumper flange 104 is a radial ergonomic cutaway 136 that allows the operator more clearance for ease and range of motion when gripping handle assembly 100. Bumper flanges 104 are preferably manufactured of a elastomeric compound with a durometer hardness less than 100 Shore-A, more preferably of an elastomeric compound with a durometer hardness less than 70 Shore-A. Bumper flanges 104 are preferably manufactured of polyurethane, but any suitable shock absorbing material may be used.

An isometric view of an attachment plate 114 in accordance with the preferred embodiment is shown in FIG. 7. Attachment plate 114 has an attachment end 140, and a handle end 142. Handle end 142 includes a clearance hole 144 while attachment end 140 includes tapers 146 to facilitate welding. The exterior profile of handle end 142 is sized and shaped so that it fits snugly within the socket 134 of bumper flange 104 of FIG. 5, with clearance hole 144 aligning with bore 132.

FIG. 8 details rigid handle member 106 from FIG. 4. Handle member 106 preferably includes a bolt head 150, a smooth body portion 152, and a threaded end 154. Smooth body portion 152 is sized to fit snugly within clearance holes 144 of attachment plate 114, and within bore 130 of bumper flange 104. Threaded end 154 of handle member 106 is preferably of equal or smaller diameter to smooth body portion 152 and engages corresponding threads of retainer 110 of FIG. 4. The preferred embodiment of the present invention uses a standard hex head screw to perform the duties of handle member 106 although a different or more customized component may be substituted in its place.

Referring again to FIG. 4, the installation and assembly of safety handle assembly 100 can be described. First, the desired location of safety handle assembly 100 must be identified about the perimeter of manual tong body 102. Once the installation location has been identified, the existing handle device, if there is one, must be removed. Any method of removal is acceptable as long as the mounting locations are left in a condition suitable for welding.

Once the mounting location has been properly prepared, attachment plates 114 can be installed. Attachment plates 114 are preferably installed by placing them in their desired positions and securing them in place with welds 116 above and below plates 114. The relative position of the plates is determined by the specific application and can be at any orientation as long as the clearance holes 144 of the two attachment plates 114 line up coaxially with one another. The relative distance between the two plates 114 is a function of the amount of hand height clearance d desired by the operator. Typical installations will utilize a d value of approximately 6–8 inches but more or less hand height clearance can be used, depending on the space limitations of the equipment. Following weld installation of attachment flanges, regions surrounding the weld areas should be properly stress-relieved in accordance with appropriate manufacturing procedures. For installations where attachment by welding is not feasible or desirable, other attachment methods may be incorporated into the design of the attachment places. Such methods include but are not limited to brazing, soldering, upsetting, threading, riveting, and pinning. Of course, new cast tong parts 102 may include attachment plates 114 as an integral part of original casting such that welding or other attachment methods are not required.

Once attachment plates 114 have been properly mounted and heat treated, handle assembly 100 can be attached as follows. First, bumper flanges 104 are fitted snugly over the handle ends 142 of attachment plates 114, making sure to orient them so that ergonomic cutaways 136 are oriented away from tool body 102, as shown in FIG. 4, or as otherwise desired. It is preferred that bumper flanges 104 fit snugly onto attachment plates 114 to increase the long term durability of the handle, as loose fitting bumpers 104 can experience premature wear. Following the mounting of bumper flanges 104, a washer 112 is placed within counterbore 132 of top bumper flange 104 and handle member 106 is inserted through washer 112, bumper flange 104, and attachment plate 114. Once handle member 106 has passed through top bumper flange 104, grip cover 108 is positioned between bumper flanges 104 so that handle member can engage cover 108, bottom bumper flange 104 and aligned with bores 130, and handle member 106 is inserted the rest of the way through cover 108, lower bumper 104, and bottom attachment plate 114, until head 150 rests on upper washer 112. Once fully engaged, lower washer 112 is installed and retainer 110 is threaded onto threaded end 154 of handle member 106.

Connecting bumper flanges 104 to attachment plates 114 in this manner allows bumper flanges 104 to be easily removed and replaced. Additionally, rigid handle member 106 provides a primary gripping device that is effectively integral with manual tong 52. Therefore, if bumper flanges 104 are damaged or somehow become detached from handle assembly 100, the remaining handle components can continue to be used without interrupting rig operations if replacement bumpers are not immediately available.

Grip cover 108 is preferably constructed of a material that provides a comfortable and tactile surface for the operator's hand. The material for grip cover 108 is preferably an elastomeric compound that is relatively soft in comparison to material of grip member 106. Additionally, grip cover can be manufactured with a smooth, textured, or hand contoured surface to enhance gripping ability and reduce slippage.

Figure 3A:
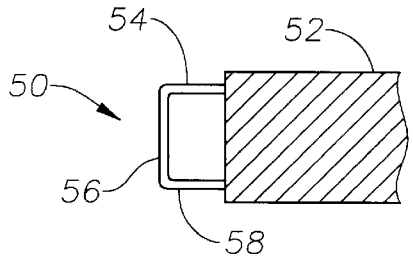
Fig. 3a (Prior Art)
FIG. 3*a* is a close up view of a manipulation handle of the manual tong apparatus of FIG. 1.
Figure 3C:
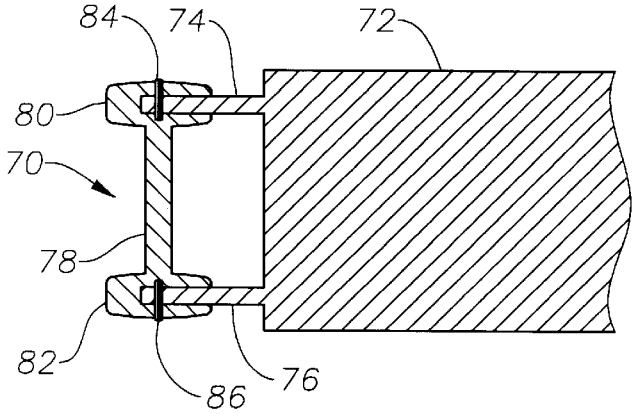
Fig. 3c (Prior Art)
Figure 3B:
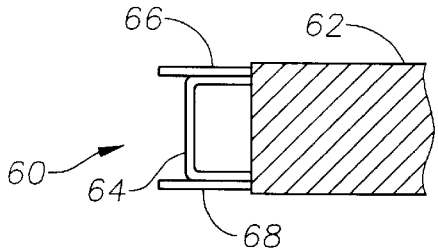
Fig. 3b (Prior Art)
FIG. 3*b* is a close up view of an alternative embodiment to the manipulation handle of FIG. 3*a;*

In comparison to the one-piece dumbbell handle 78 of FIG. 3*a,* multi-piece assembly 100 offers all the protective capabilities of the prior art design, but is significantly more durable. Hence, the present multi-piece handle assemblies 100 can be deployed throughout the oilfield drilling/work over rig industry without the concerns of ruggedness that arise with the one-piece dumbbell 70 of the prior art. Furthermore, while though the multi-piece safety handle assembly 100 of the present invention is described above as a component for a manual tong device, the concept can be incorporated with little modification into any piece of heavy equipment.

In alternative embodiments, bumper flanges 104 can be configured such that they are wholly between or wholly outside of attachment plates 114. That is, it is preferred but not necessary that attachment plates 114 engage corresponding recesses 134 as recited above. If flanges 104 were positioned outside of plates 114, they would be sandwiched between head 150 and upper plate 114 and between retainer 110 and lower plate 114, respectively. If flanges 104 were between plates 114, it would be necessary to provide an alternative support mechanism, such as a shoulder on handle member 106 or the like. Alternatively, bumper flanges 104 could be formed integrally with grip cover 108, although this embodiment is not preferred.

In another alternative embodiment, handle member 106 is used with only a single attachment flange and with one or two bumper flanges 104. In this embodiment, threaded connectors are used to maintain handle 106 in its desired position relative to the one attachment flange. This embodiment does not provide the full circle of protection that is provided by the preferred embodiment, but may nevertheless sometimes be preferable, such as, for example, when there is not sufficient vertical space on the equipment in question to mount a pair of attachment flanges.

The above discussion is meant merely to be illustrative of the principles and various embodiments of the present invention. Numerous variations and modifications will become apparent to those skilled in the art once the above disclosure is fully appreciated. For example, the relative dimensions and geometries of various parts, the materials from which the components are made, the manner in which certain pieces are connected, and other parameters can be varied. The scope of the following claims should not be limited by the description set out above.

What is claimed is:

1. A handle assembly for a manual pipe tong apparatus, comprising:

a pair of rigid attachment members, each rigid attachment member having a mounting end and a handle end, each handle end including a mounting bore therethrough, said mounting ends being rigidly affixed to the pipe tong apparatus such that said handle ends are spaced apart a desired distance and said mounting bores are substantially aligned;

a shock absorbing member received on each handle end, each shock absorbing member including a clearance hole therethrough, said clearance holes aligning with said mounting bores when said shock absorbing members are affixed to said handle ends; and a handle extending through said shock absorbing members and through said mounting bores, said handle being affixed to said attachment members such that disengagement of both of said shock absorbing members from said attachment members does not result in disengagement of said handle from said attachment members.

2. The handle assembly of claim 1 wherein each shock absorbing member includes a socket that corresponds in shape to a handle end and receives said handle end.

3. The handle assembly of claim 1 wherein said shock absorbers comprise an elastomeric material.

4. The handle assembly of claim 3 wherein said elastomeric material is polyurethane.

5. The handle assembly of claim 1 wherein said shock absorbers are generally cylindrical in shape.

6. A handle assembly for a manual pipe tong apparatus, comprising:

a pair of rigid attachment members, each rigid attachment member having a mounting end and a handle end, each handle end including a mounting bore therethrough, said mounting ends being rigidly affixed to the pipe tong apparatus such that said handle ends are spaced apart a desired distance and said mounting bores are substantially aligned;

a shock absorbing member received on each handle end, each shock absorbing member including a clearance hole therethrough, said clearance holes aligning with said mounting bores when said shock absorbing members are affixed to said handle ends;

a handle extending through said shock absorbing members and through said mounting bores; and means for retaining said handle at a desired position with respect to said attachment members a handle assembly for a manual pipe tong apparatus, comprising:

wherein each of said shock absorbers incorporates a cut-away diametrically opposite from said socket to allow more access to said gripping member.

7. The handle assembly of claim 1 further comprising an ergonomic cover surrounding said handle.

8. The handle assembly of claim 7 wherein said ergonomic cover comprises a textured slip-resistant outer cover.

9. The handle assembly of claim 7 wherein said ergonomic cover is molded to contour the shape of an operator's hand.

10. The handle assembly of claim 7 wherein said ergonomic cover is manufactured from an elastomer.

11. The handle assembly of claim 7 wherein said ergonomic cover comprises a length of hose.

12. The handle assembly of claim 1 wherein said handle comprises a threaded fastener.

13. The handle assembly of claim 12 wherein said threaded fastener is a bolt or a screw.

14. The handle assembly of claim 12 wherein said threaded fastener is secured at one end by a nut.

15. The handle assembly of claim 12 wherein said threaded fastener is a threaded stud.

16. The handle assembly of claim 15 wherein said threaded fastener is secured by at least one nut.

17. The handle assembly of claim 1 wherein said handle remains secured and operable if said shock absorber becomes damaged or is removed.

18. The handle assembly of claim 1 wherein said means for retaining said handle at said desired position comprises non-threaded fasteners.

19. A handle for a movable apparatus, comprising:

a pair of attachment members secured to said movable apparatus parallel with each other and spaced a first distance apart, each of said attachment members including a hole therethrough;

a substantially rigid handle extending through said holes and spanning said first distance;

shock absorbers mounted on each of said attachment members; and said handle and said shock absorbers being affixed to said attachment members such that disengagement of both of said shock absorbers from said attachment members does not result in disengagement of said handle from said attachment members.

20. The handle of claim 19 wherein said shock absorbers comprise polyurethane.

21. The handle of claim 19 wherein at least one of said holes is threaded to correspond with a threaded portion of said handle.

22. The handle of claim 19, further including an elastomeric gripping member supported on said handle, wherein said gripping member remains secured and operable if said shock absorber becomes damaged or is removed.

23. The handle of claim 19 wherein each of said shock absorbers includes a hole therethrough and said holes correspond to said holes in said attachment members when said shock absorbers are mounted on said attachment members.

24. A handle mounted about a movable apparatus comprising:

a pair of attachment members secured to said movable apparatus parallel with each other;

each of said attachment members comprising a generally circular hole to receive a rigid bolt therethrough, said holes defining an axis;

a gripping member aligned with said axis and received in said holes shock absorbers mounted over each of said attachment members at opposite ends of said gripping member;

a grip cover mounted about said gripping member between said attachment members and said shock absorbers to provide comfort to an operator; and said grip cover comprising an elastomer that is relatively soft in comparison to material of said gripping member;

wherein each of said shock absorbers includes a cut-away to allow the operator's hand more access to said gripping member.

25. A handle assembly for a manual pipe tong apparatus, comprising:

a pair of rigid attachment members, each rigid attachment member having a mounting end and a handle end, each handle end including a mounting bore therethrough, said mounting ends being rigidly affixed to the pipe tong apparatus such that said handle ends are spaced apart a desired distance and said mounting bores are substantially aligned and define a handle axis;

a shock absorbing member received on each handle end, each shock absorbing member including a clearance hole therethrough, said clearance holes aligning with said mounting bores when said shock absorbing members are received on said handle ends; and a handle extending through said shock absorbing members and through said mounting bores, said handle being affixed to said attachment members such that said handle remains secured and operable if said shock absorbing members become damage or are removed;

wherein said shock absorbing members extend farther from said handle axis than does said handle.

26. A handle assembly for a manual pipe tong apparatus, comprising:

a pair of rigid attachment members, each rigid attachment member having a mounting end and a handle end, each handle end including a mounting bore therethrough, said mounting ends being rigidly affixed to the pipe tong apparatus such that said handle ends are spaced apart a desired distance and said mounting bores are substantially aligned;

a bumper flange received on each handle end, each of said bumper flanges including a clearance hole therethrough, said clearance holes aligning with said mounting bores when said bumper flanges are affixed to said handle ends;

a handle extending through said bumper flanges and through said mounting bores; and means for retaining said handle at a desired position with respect to said attachment members.

27. The handle assembly of claim 26 wherein said bumper flanges comprise an elastomeric material.

28. The handle assembly of claim 26 wherein each of said bumper flanges incorporate a cut-away diametrically opposite from said socket to allow more access to said gripping member.

29. The handle assembly of claim 26 further comprising an ergonomic cover surrounding said handle.

30. The handle assembly of claim 26 wherein said handle remains secured and operable if said bumper flanges become damaged or are removed.

31. The handle assembly of claim 26 wherein said shock absorbing members extend farther from said handle axis than does said handle.

* * * * *